US008905363B2

(12) United States Patent
McCaul

(10) Patent No.: US 8,905,363 B2
(45) Date of Patent: Dec. 9, 2014

(54) NOTCHED PAINT BRUSH

(75) Inventor: Glenn Nelson McCaul, Courtice (CA)

(73) Assignee: LDRRS Inc., Courtice, Ontario (CA)

( * ) Notice: Subject to any disclaimer, the term of this patent is extended or adjusted under 35 U.S.C. 154(b) by 0 days.

(21) Appl. No.: 13/393,903

(22) PCT Filed: Sep. 2, 2010

(86) PCT No.: PCT/CA2010/001416

§ 371 (c)(1),
(2), (4) Date: Mar. 2, 2012

(87) PCT Pub. No.: WO2011/026246

PCT Pub. Date: Mar. 10, 2011

(65) Prior Publication Data

US 2012/0260445 A1 Oct. 18, 2012

Related U.S. Application Data

(63) Continuation of application No. 12/822,327, filed on Jun. 24, 2010, now abandoned.

(30) Foreign Application Priority Data

Sep. 4, 2009 (CA) ..... 2677618

(51) Int. Cl.

| | |
|---|---|
| ***A47B 96/06*** | (2006.01) |
| ***A46B 17/02*** | (2006.01) |
| ***B44D 3/12*** | (2006.01) |

(52) U.S. Cl.

CPC ..... *A46B 17/02* (2013.01); *B44D 3/123* (2013.01); *A46B 2200/202* (2013.01)

USPC ..... 248/213.2; 248/110; 248/692; 15/246

(58) Field of Classification Search

CPC .... A46B 17/02; A46B 17/00; A46B 220/202; B44D 3/123

USPC ..... 248/110, 111, 213.2, 312.1, 692; 15/143.1, 159.1, 246

See application file for complete search history.

(56) References Cited

U.S. PATENT DOCUMENTS

| | | | |
|---|---|---|---|
| 1,277,019 | A | 8/1918 | Wright |
| 2,273,642 | A | 2/1942 | Henderson |
| 2,309,990 | A | 2/1943 | Savi |

(Continued)

*Primary Examiner* — Gwendolyn W Baxter
(74) *Attorney, Agent, or Firm* — Young & Thompson

(57) ABSTRACT

A paint brush is attached to the rim of the mouth of a paint can such that the bristles of the brush are vertically above the mouth of the can and are oriented at an angle of between about 0 and about 90 degrees from the vertical. A notch is formed on the side of the mid portion of the brush between the handle and the bristles or in the ferrule of a paint brush where the brush is provided with one. The notch is defined by an upper face oriented toward the handle of the brush, and a lower face oriented toward the set of bristles. The upper face, the lower face as well as the space between the upper and lower faces are all dimensioned such that when the brush is attached to the rim of the paint can, the rim bears against the notch at a point adjacent to its upper face while the lower face of the notch bears against the rim sufficiently to position the brush at an angle from the vertical of less than about 90 degrees.

5 Claims, 4 Drawing Sheets

(56) References Cited

U.S. PATENT DOCUMENTS

| | | | | |
|---|---|---|---|---|
| 2,272,826 | A | 11/1955 | Zanelli | |
| 3,231,919 | A | 2/1966 | MacDonald | |
| 3,432,875 | A * | 3/1969 | Edelson et al. | 15/246 |
| 3,961,729 | A | 6/1976 | Grimm | |
| 4,821,361 | A | 4/1989 | Meimeteas | |
| 4,887,327 | A | 12/1989 | Meimeteas | |
| 5,087,014 | A | 2/1992 | Desjardin | |
| 5,406,668 | A | 4/1995 | Goodhue | |
| D365,210 | S | 12/1995 | Bell | |
| 5,636,904 | A | 6/1997 | Bell | |
| 5,689,851 | A | 11/1997 | Jacquet | |
| 5,769,383 | A | 6/1998 | Hemler | |
| 6,244,559 | B1 | 6/2001 | Stanton | |
| 7,658,352 | B2 | 2/2010 | Gronbach | |

* cited by examiner

NOTCHED PAINT BRUSH

This application is a 371 national stage application of PCT/CA2010/001416, filed Sep. 2, 2010, which claims pursuant to 35 USC 119 benefit of priority of Canadian application No. 2,677,618, filed Sep. 4, 2009, the entire contents of which are herein incorporated by reference in their entirety.

FIELD OF THE INVENTION

This invention relates to paint brushes and more particularly to a paint brush having a notch formed in its handle or ferrule for hanging the paint brush to the rim of a conventional paint can. The invention also particularly relates to a clip which removably attaches to a paint brush and which has a notch for hanging the paint brush to the rim of a paint can.

BACKGROUND OF THE INVENTION

In the interval of time between the period that a painter is not using a paint brush, it is customary for him to place the brush on the can which contains the paint. The painter does so because the paint can is a handy place to place the brush at such times and because the paint in the can is not discoloured by paint from the brush which might dribble into it. The problem with using a paint can for this purpose however is that paint can run from the can onto a surface on which it rests. Furthermore, a brush can be too easily knocked off a paint can by a painter's carelessness.

It is known to provide paint brushes with hangars or other means to facilitate the attachment of the brush to a paint can. Examples of such attachment means are described in U.S. Pat. No. 2,309,990 to Savi, no. 3,231,919 to MacDonald, no. 4,887,327 to Meimeteas and no. 6,244,559 B1 to Stanton. The attachment means described in these patents are suitable for attaching a paint brush to a paint can so that the brush does not easily fall off of the can but they do have a number of short-comings, one of which is that they project outwardly from the paint brushes and can be a nuisance to painters when they are painting in confined spaces. As well the projecting attachment means are easily damaged and, once damaged, are not reliable for attaching a paint brush to a can. A still further short-coming of some of the above mentioned attachment means is that the paint brush is suspended outside the paint can where paint on the brush can fall onto surfaces beside the paint can.

I have invented a paint brush and a clip for a paint brush that have none of the short-comings mentioned above. Specifically, the means by which the brush is attached to a paint can does not project outwardly from the brush when the brush is in use and, as a result, the attachment means does not interfere with the painter's use of the brush. Furthermore the attachment means is not as susceptible to breakage as are projecting attachment means such as those mentioned above. In addition, my attachment means suspends a paint brush over the mouth of a can of paint so that any paint that tans from the brush falls into the can and not outside it.

SUMMARY OF THE INVENTION

Briefly, the paint brush of my invention is used use in conjunction with a paint can having an upwardly opening mouth defined by a continuous upwardly extending rim or perimeter having upper and lower edges and, adjacent thereto and radially outwardly of the mouth, a continuous upwardly opening groove. The paint brush has a ferrule with front and back walls and a pair of side walls which interconnect the front and back walls.

The ferrule has a notch which extends inward from one of the side walls and which is defined by upper and lower faces. The upper face has a generally horizontal central front edge and a pair of upper lateral edges on opposite sides of the upper central edge. Each lateral edge is formed in a separate front and back wall of the ferrule and extends upward and away from the central edge. The lower face has a generally horizontal lower central front edge and is spaced apart from the upper central edge. The lower face further has a pair of lower lateral edges formed in a separate front and back wall of the ferrule and is on opposite sides of the lower central edge.

Alternatively, where the paint brush lacks a ferrule, the notch can be formed in the mid portion of the brush between the bristles and the handle. The notch can have the same shape as the notch formed in the ferrule described above.

As a further alternative, a notch of the same shape can be formed in a clip which removably attaches to a paint brush. The clip can be removed from the paint brush when the brush is in use and attached when the brush is not in use.

The paint brush is adapted to hang from the rim of a paint can such that the upper face of the notch rest upon the upper edge of the rim while the lower face of the notch contacts the lower edge of the rim. When the paint brush is hanging in this way, its bristles are vertically above the mouth of the paint can.

In accordance with another aspect of the present invention, the pain brush can be attached to the rim or perimeter portion of a paint can opening such that the bristles of the brush are oriented into the paint can at an angle of less than 90 degrees from the vertical. The perimeter of the paint can has an upwardly extending rim having upper and lower ends while the paint brush has a mid portion connecting a handle to a set of bristles. A notch is provided on a side of the mid portion between the handle and the set of bristles for attaching the brush to the edge of the mouth of the can. The notch is defined by an upper face oriented towards the handle, a lower face oriented towards the set of bristles and an opening separating the upper and lower faces. The opening, upper face and lower face are all dimensioned such that when the brush is attached to the perimeter of the paint can, the perimeter bears against the notch at a point adjacent to the upper face while the lower face bears against the perimeter sufficiently to position the brush at an angle from vertical of less than 90 degrees.

In accordance with still further aspect of the invention, the paint brush is used in conjunction with a paint can having an opening circumscribed by an upwardly extending rim having upper and lower ends. The paint brush includes a ferrule connecting a handle to a set of bristles and a notch formed on a side of the ferrule between the handle and the set of bristles. The notch is defined by an upper face formed on the ferrule towards the handle, a lower face formed on the ferrule towards the set of bristles, an opening separating the upper and lower faces and a back face formed on the ferrule and separated from the opening by a depth. The notch is dimensioned to permit the paint brush to be hung from the rim of the paint can by passing the upper end of the rim through the opening. The opening, depth, upper face and lower face all being dimensioned to hold the upper end of the rim within the notch while the lower face of the ferrule bears against the rim at a point on the rim between the upper and lower ends when the paint brush is hung from the rim.

In accordance with a further aspect of the invention, the paint brush is used in conjunction with a paint can having an opening circumscribed by an upwardly extending rim having upper and lower ends. The paint brush includes a ferrule connecting a handle to a set of bristles and a notch formed on a side of the ferrule between the handle and the set of bristles.

The notch is defined by an upper face formed on the ferrule towards the handle, a lower face formed on the ferrule towards the set of bristles and an opening separating the upper and lower faces. The notch is dimensioned such as to permit the paint brush to be hung from the rim of the paint can by passing the upper end of the rim through the opening, the upper face being angled and dimensioned to hold the upper end of the rim within the notch when the paint brush is hung from the rim, the opening being dimensioned to position the lower face of the notch at a point on the rim between the upper and lower ends when the paint brush is hung from the rim.

DESCRIPTION OF THE DRAWINGS

The paint brush and clip of the invention are described with reference to the accompanying drawings in which.

Like reference characters refer to like parts throughout the description of the drawings.

DESCRIPTION OF PREFERRED EMBODIMENTS

Figure 1:
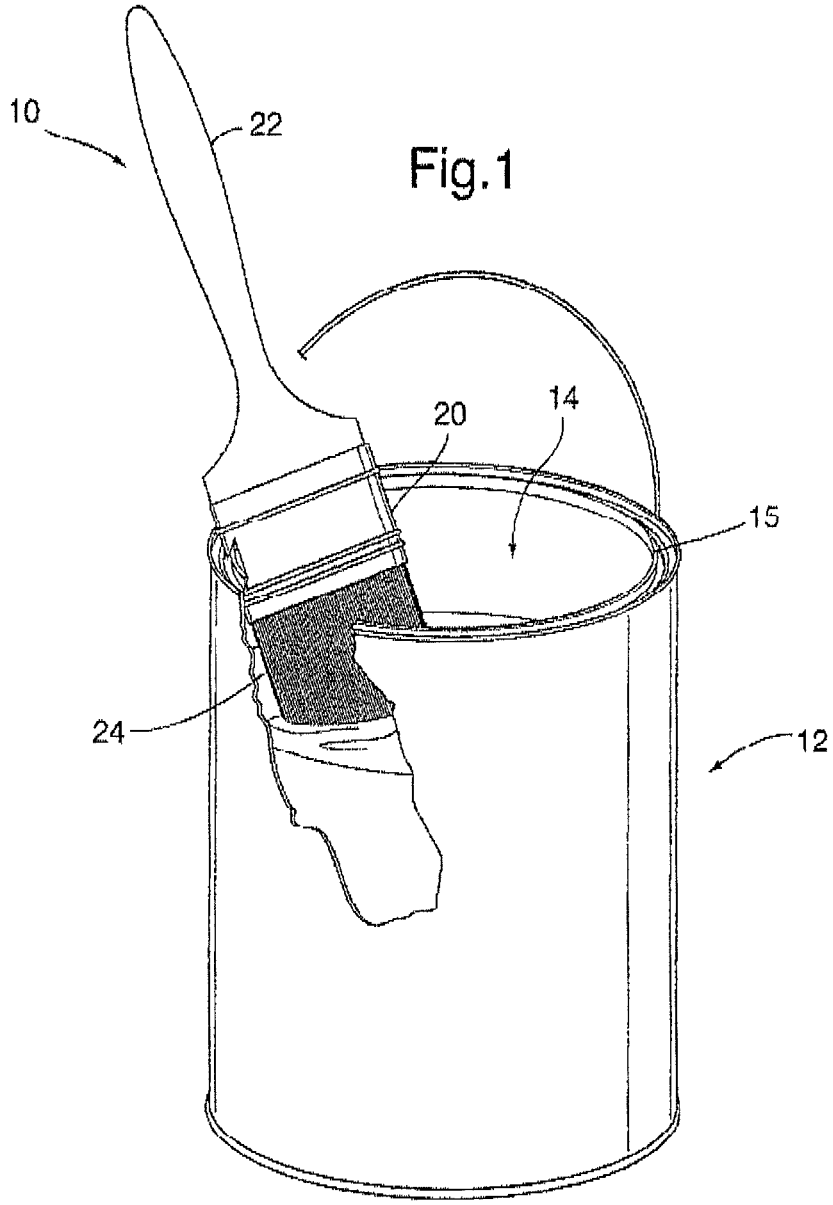
FIG. 1 is a perspective view of the paint brush and a paint can partly cut away.
Figure 3:
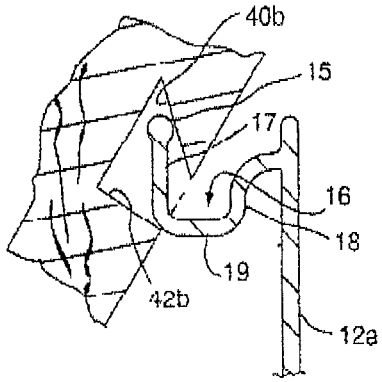
FIG. 3 is a section, in enlarged scale, of the notch formed in the ferrule of the paint brush. in conjunction with a portion of the rim of the paint can.

With reference to FIGS. 1 and 3, the subject paint brush, generally 10, is shown in conjunction with a conventional paint can, generally 12, The paint can has a bottom wall, side walls which extend upwardly and terminate at an upwardly opening mouth 14 defined by a continuous upwardly extending rim or perimeter 15. Radially outwardly of the rim is a circular upwardly opening groove, generally 16, defined by inner and outer lips 17, 18 and a transverse portion 19 which defines the lower wall of the groove. Outer lip 18 is radially inward of the outer wall 12*a* of the paint can.

Figure 2:
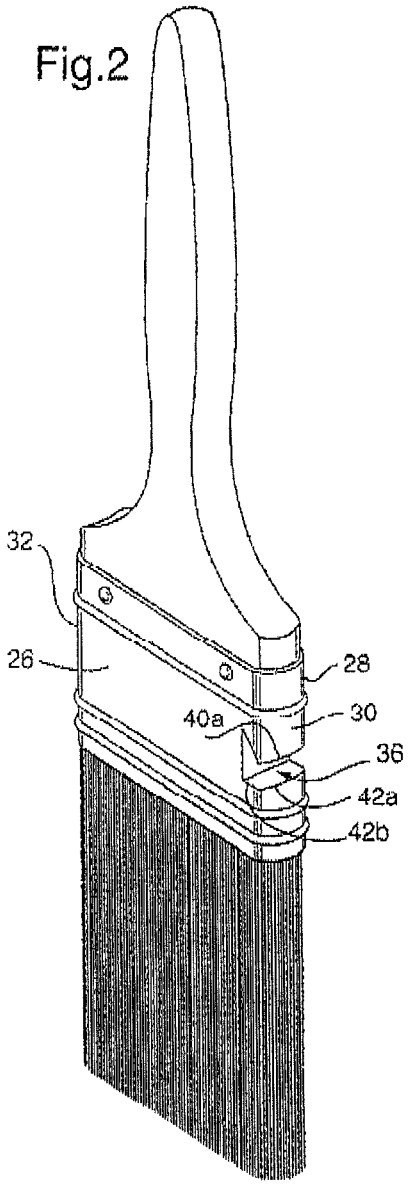
FIG. 2 is a perspective view of the paint brush.
Figure 4:
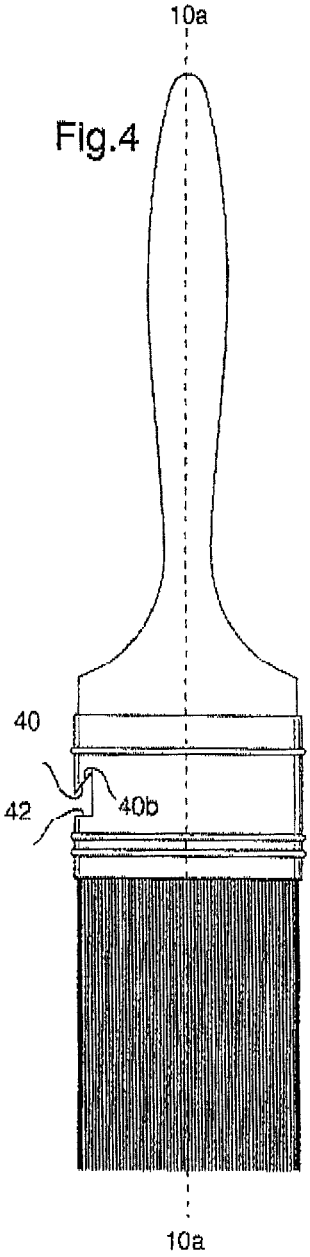
FIG. 4 is an elevation of the paint brush.

With reference to FIGS. 1, 2 and 4, the paint brush has a ferrule 20 connecting a handle 22 and bristles 24. The ferrule has oppositely facing front and back walls 26, 28 and a pair of oppositely facing side walls 30, 32 which interconnect the front and back walls. The side walls have a width which is short relative to that of the front and back walls.

Instead of the set of bristles illustrated in the foregoing drawings, the paint brush may provided with a foam pad for applying paint.

In the foregoing respects, the paint brush is conventional. However the paint brush differs from conventional brushes in the provision of a notch generally 36, which extends inward from side wall 30.

With reference to FIGS. 4 and 2, notch 36 is defined by upper and lower faces 40, 47, respectively. When the longitudinal axis 10*a*-10*a* of the brush is vertical, the upper face 40 has a generally horizontal central edge or portion 40*a* which is formed in the side wall of the ferrule and a pair of upwardly inclined lateral edges or portion (one visible and numbered 40*b* in FIG. 3) on opposite sides of the upper central portion. One upper edge 40*b* is formed in front wall 26 of the ferrule while the other upper lateral edge is formed in back wall 28. Each upper lateral edge extends upwardly and away from the central portion.

The lower edge has a generally horizontal lower central portion 42*a* which is formed in side wall 30 and spaced apart from the upper central portion 40*a*. A pair of generally horizontal lower lateral edges (one visible and numbered 42*b*) are formed in the front and back walls of the ferrule and those lateral edges are horizontal when the longitudinal axis of the brush is vertical.

It will be observed that the upper face 40 is inclined at an oblique angle relative to the longitudinal axis 10*a*-10*a* of the brush, preferably at an angle of about 45 degrees, while the lower face 42 is inclined normal to the longitudinal axis.

With reference to FIGS. 1 and 3, the paint brush is adapted to hang from rim 15 of the paint can when the upper lateral edges 40*b* of the notch rest upon rim 15 while the lower central portion 42*a* of the notch contacts the lower surface of transverse portion 19, The bristles, when the paint brush is so hanging, are disposed within the mouth so that any paint that drops from the bristles falls into the paint can.

The notch is dimensioned and configured to attach to the mouth or perimeter of a paint can such that the brush is firmly secured to the rim and is held such that its longitudinal axis is disposed at an acute angle from the vertical, i.e. with the bristles vertically above the interior of the paint can or, where the bristles are within the can as illustrated in FIG. 1, above the contents of the paint can.

Figure 3A:
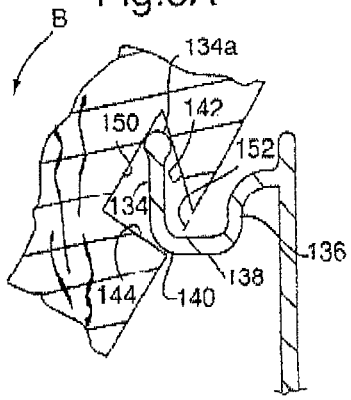
FIG. 3A is another section, in enlarged scale, of a notch somewhat different from that illustrated in FIG. 3.

With reference to FIG. 3A, the mouth or perimeter of the paint can consists of an inner lip 134 and an outer lip 136. Inner lip 134 forms an L-shaped section which extends radially inwardly from outer lip 136. Transverse portion 138 extends between tuner lip 134 and outer lip 136. The top end 134*a* of the inner lip defines the rim or perimeter of the mouth of the paint can while the bottom end of the inner lip ends in an elbow 140 which is integral with transverse portion 138.

The notch is configured such that its upper face 142 rests upon top end 134*a* of the inner lip and extends between the inner and outer lips while the lower face 144 of the notch abuts against inner lip 134 at a point between its bottom end and transverse portion 138. The point of contact between lower face 144 and inner lip 134 is preferably at elbow 140 or between elbow 140 and top end 134*a*. With lower face 144 braced against inner lip 134 and upper face 142 braced against top end 134*a* on the opposite side of inner lip 134, the notch effectively locks onto the perimeter of the paint can by virtue of the torque, indicated by arrow B, which is applied to the brush by its weight. As a result, the brush is prevented from accidentally dislodging from the perimeter of the paint can because its inner lip 134 is effectively pinched between upper the upper and lower faces of the notch.

The back face 150 of the notch is spaced from the entrance 152 of the notch by a depth which is selected to ensure that a portion of inner lip 134 will fit inside the notch. If the notch is too shallow, i.e. if the space between the entrance to the notch 152 and back face 150 is too short, then the notch may not secure the paint brush to the perimeter very securely. Preferably, the length of the entrance 152 measured parallel to the longitudinal axis of the paint brush is 1/8th inch. Preferably also, back face 150 is about 3/16 of an inch from the entrance.

Figure 6:
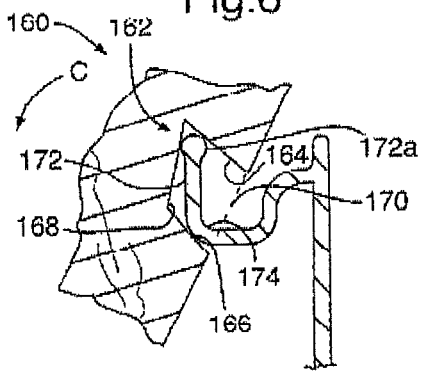
FIGS. 6 to 8 are sections, in enlarged scale, of notches of different shapes, formed in the ferrule of the paint brush.

A subtle modification of the relative dimensions of lower face 144, upper face 142 and the depth of the notch can be made while not departing from how the notch secures the brush to the rim of a paint can. For example, FIG. 6 shows an alternate embodiment of the present invention showing a paint brush 160 having a notch 162 with the lower face 166 and upper face 164 and back face 168 and an entrance 170 to the notch between faces 164 and 166. In this embodiment, entrance 170 is dimensioned such that inner lip 172 fits into the inside of the notch. The lower face 166 of the notch is dimensioned and configured such that the face bears against elbow 174 while the top end 172*a* of the inner lip is held against upper face 164. As in the previous embodiment, the inner lip 172 is pinched between lower and upper faces 166, 164 and the torque acting on brush 160 (indicated by arrow C) being sufficient so that the pinching action is strong enough to lock the brush onto the perimeter.

Figure 7:
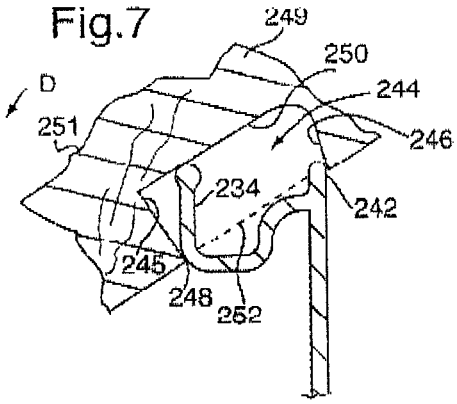

As can be seen from FIG. 7, the notch can be made sufficiently large that the notch couples the brush to the perimeter of the paint can in the same manner as in the previous two embodiments by spaning the entire perimeter. In this embodiment brush 251 has a mid portion 249 with a notch 244 formed therein. Notch 244 has an upper face 246, a lower face 245 (with a outer corner 248) an entrance or opening 252 and a back. face 250. Entrance 252 is sufficiently large that it can span between outer lip 242 and inner lip 234 of the perimeter. The depth of notch 244 i.e. the space separating entrance 252 from back face 250, is sufficiently large to permit a portion of inner lip 234 to fit within the notch. Upper face 246 and lower face 245 are also dimensioned so that outer lip 742 bears against upper face 246 and lower face 245 bears against inner lip 234. As in the previous embodiments, the force of gravity acting on the brush creates a torque, illustrated by arrow D, which causes notch 244 to pinch the perimeter between upper face 246 and tower face 245 thereby securing the brush tightly to the perimeter of the paint can.

Figure 5:
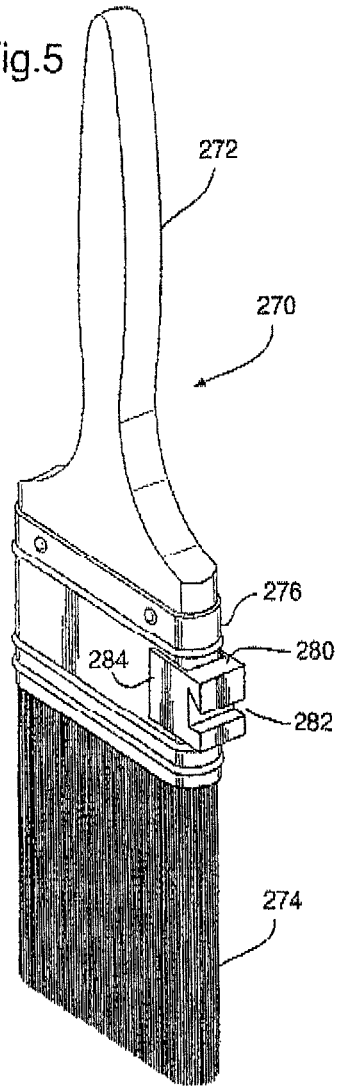
FIG. 5 is a perspective view of the paint brush and a clip of the invention.

An alternate embodiment of the present invention is shown in FIG. 5 and includes a standard paint brush, generally 270 having a handle 272, bristles 274 and a mid portion 276. Attached to mid portion is a clip 280 having a notch 282 formed thereon. The notch may be the same as any of the notches described above, the only difference being that instead of being formed on the mid portion itself, the notch is formed on clip 280. The clip may be made of injection moulded plastic or aluminum and is seemed to mid portion 276 by means known generally in the art such as by adhesive or by fasteners. Alternatively the clip may be made of resiliently deformable material such as spring steel or resiliently deformable plastic and is biased against the front and back faces of the ferrule by the inward pressure from the two ears 284. When the clip is secured to the brush in the illustrated manner, the brush can be mounted in a paint can as in the previously describe embodiments.

Figure 8:
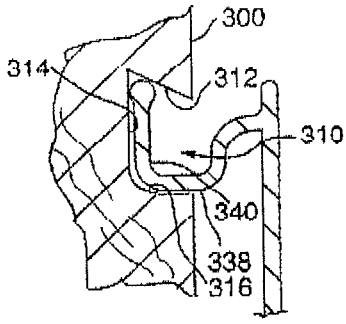

A further embodiment of the present invention is shown in FIG. 8 and includes a standard paint brush having a handle portion with a mid portion 300 having notch 310 which is defined by upper face 312, back face 314 and lower face 316. Lower face 316 is contoured to closely match the curve of transverse portion 338 of the groove at the mouth of the paint can so as to hold inner lip 340 of the paint can firmly between upper and lower faces 312, 316 of the notch in contact with the inner lip.

The present invention permits the paint brush to he securely attached to the inner lip of the paint can so that the paint brush does not accidentally become dislodged. The brush is not simply hanging onto the inner lip, rather the faces of the notch effectively pinch the inner lip such that the force of gravity acting on the bristle portion of the brush is sufficient to effectively lock the paint brush in place. The pinching action of the lower face of the notch on the inner lip of the paint can is sufficiently strong that when the paint brush is mounted to the paint can as shown in FIG. 1, if the paint brush is lifted, the can is lifted as well A paint brush made in accordance with the present invention has several advantages. First, simply mounting the brush on the inner lip of the paint can is sufficient to cause the excess paint on the brush to simply drip off the brush and into the can. Also, the paint brush can be stored temporarily on the paint can when the user needs to put down the paint brush in order to do something else. The user can simply unhook the paint brush from the can in order to start painting again. Also, while the paint brush can be mounted to the inner lip of a paint can as discussed above, the same brush can also be hung in a similar fashion to a rack or other mount. For example, a paint brush rack can be made having an elongated U shaped trough having a similar structure as the inner lip or rim of a paint can. If this U-shaped trough is dimensioned in the same way as the rim of a paint can, then one or more brushes can be mounted to the rack as if the rack is one large paint can.

In the foregoing description, the notch is sometimes described as being formed in a ferrule and sometimes formed in the mid section of a brush which lacks a ferrule. For purposes of the present invention, it does not matter whether the notch is formed in a ferrule or in the mid section of a brush which lacks a ferrule. The notch is equally effective whether formed on either one. As well, while bristles are frequently referred to in the description, for purposes of the present invention, it does not matter whether the brush has bristles or has a foam pad since the shape of the notch is not affected by either one.

It will be understood, of course, that many other modifications can be made in the shape or other features of the notch in the paint brush or the clip of the invention without departing from the scope, and purview of the invention as defined in the appended claims.

I claim:

1. A clip for attachment to a paint brush for use with a paint can having a bottom wall, side walls which extend upwardly and terminate at an opening circumscribed by a perimeter, said perimeter having a U shaped profile with an outer rim, a transverse portion and an upwardly extending inner rim having upper and lower ends, said clip having a notch for attaching the brush to the inner rim, the notch defined by an upper face, a lower face and an opening separating the upper and lower faces; the opening, upper face and lower face being dimensioned such that when the clip is attached to the perimeter of the paint can while the bottom wall is resting on a level surface, the upper face is inclined at an oblique angle, the perimeter bears against the upper face while the lower face bears against the inner rim sufficiently to lock the notch onto the perimeter by virtue of a torque which is applied to the paint brush by its weight and to position the brush at an angle from the vertical of less than 90 degrees.

2. The clip as defined in claim 1 wherein said brush is provided with a ferrule located at the mid point of the brush, said notch further comprising a back face, the back face being separated from the opening by a depth, the opening, depth, upper face and lower face all being dimensioned to hold the upper end of the rim within the notch while the lower face of the ferrule bears against the rim at a point on the rim between the upper and lower ends when the paint brush is hung from the rim.

3. The clip as defined in claim 1 wherein said brush is provided with a ferrule, said notch further comprising a back face, the back face being separated from the opening by a depth, the opening, depth upper face and lower face all being dimensioned and configured to hold the upper end of the rim within the notch while the lower face of the ferrule bears against the rim at a point on the rim between the upper and lower ends when the paint brush is hung from the rim.

4. The clip as defined in claim 1 wherein said brush is provided with a ferrule, said notch further comprising a back face, the back face being separated from the opening by a depth, the opening, depth, upper face and lower face all being dimensioned and configured in order to hold the rim within the notch while the lower face of the ferrule bears against the rim at a point on the rim between the upper and lower ends when the paint brush is hung from the rim.

5. The clip as defined in claim 1 wherein the transverse portion of the perimeter has a curved shape and wherein the lower face of the notch has a curved shape, the curved shape of the lower face closely matching the curved shape of the transverse portion such that the lower face can be laid closely against the transverse portion.

* * * * *